US005767427A

United States Patent [19]

Corso

[11] Patent Number: 5,767,427

[45] Date of Patent: Jun. 16, 1998

[54] FINE TUNER DEVICE FOR STRINGED INSTRUMENTS

[76] Inventor: Steve Corso, 3971 NW. 9th Ave., Pompano Beach, Fla. 33064

[21] Appl. No.: 650,328

[22] Filed: May 20, 1996

[51] Int. Cl.[6] ..... G10D 3/14

[52] U.S. Cl. ..... 84/306

[58] Field of Search ..... 84/303, 304, 305, 84/306

[56] References Cited

U.S. PATENT DOCUMENTS 4,329,904 5/1982 Monteleone ..... 84/306

*Primary Examiner*—Cassandra C. Spyrou

*Attorney, Agent, or Firm*—Robert M. Downey, P.A.

[57] ABSTRACT

A device for tuning a stringed instrument includes a housing attachable to the instrument, an elongate output shaft extending from within a gear chamber of the housing and having a string spindle on a distal end zone thereof, and an in-line drive gear assembly within the gear chamber for turning the spindle in order to wind a string of the instrument thereabout, thereby adjusting the string tension. The drive gear assembly includes a first reduction gear assembly, operable by turning a first knob, for rotating the spindle in accordance with a first rate of rotation to make coarse adjustments, and a second reduction gear assembly, in-line with the first reduction gear assembly, and operable in conjunction therewith by turning a second knob, thereby rotating the spindle in accordance with a second rate of rotation for fine tuning the instrument.

11 Claims, 3 Drawing Sheets

FINE TUNER DEVICE FOR STRINGED INSTRUMENTS

BACKGROUND OF THE INVENTION

1. Field of the Invention

The present invention relates generally to tuning devices for stringed instruments and, more specifically, to a fine tuning device for stringed instruments comprising a two-stage reduction gear assembly structured to permit coarse turning and fine tuning of string tension.

2. Description of the Related Art

A stringed instrument requires accurate tuning of each of the individual strings each time the instrument is played. Most stringed instruments provide a knob which is manually turned to rotate a shaft having a spindle to which the string is attached. By rotating the knob, the string tension can be adjusted until the desired sound is achieved. In particular, the tuners on banjos and some guitars are arranged with the input shaft (adjustment knob), and the output shaft (having the spindle to which the string is attached) co-axially aligned. It has been a problem in the art to manufacture an affordable and durable tuner with this co-axial, in-line configuration that will provide accurate tuning (with an input to output shaft rotation ratio of approximately 12:1 or better) without straying from the traditional size and configuration of tuners. Standard guitar tuners use a worm gear arrangement which provides for a high input to output shaft rotation ratio. This is ideal for fine tuning the instrument. Tuners that provide for the fine tuning high ratios allow the musician to reach the desired tuning far easier, without overshooting proper string tension.

While fine ratio tuners are certainly useful to adjust string tension, they do have some drawbacks. For instance, because it takes many turns of the input shaft (adjustment knob) to achieve a single rotation of the output shaft (to which the string is attached), stringing an instrument using a fine ratio tuner can be very time-consuming. Because professional musicians have concerns about fast string replacement while performing, fine ratio tuners can be inconvenient and, in many instances, they are undesirable.

The related art includes various tuners which are structured to provide for either low or high shaft rotation devices. Examples of such proposed devices in the prior art can be found in the Kremp U.S. Pat. No. 1,506,373, Grover U.S. Pat. No. 1,669,824, and Bertram U.S. Pat. No. 1,802,937. The tuner in Kremp uses a single stage planetary gear arrangement which cannot accommodate for shaft rotation ratios much greater than 4:1, without being oversized and impractical for most instruments. Grover discloses a geared tuner which also has a limited shaft rotation ratio and an offset gear arrangement which is complex and requires a large housing. The Bertram device accomplishes a high tuning ratio, but has a complex and expensive housing. Most importantly, the design of each of these tuners, as described above, will not accommodate for both fine adjustment and coarse adjustment in a single unit.

Tuners with an in-line gear and shaft configuration are most desirable because they can be made with a narrow, streamlined housing which occupies the least amount of space. This is especially important on an instrument having five or more strings. However, the art has failed to provide a tuner having an in-line gear configuration (along a central longitudinal axis) which is structured to enable both coarse adjustment and fine tuning adjustment. There is, therefore, a need in the art for a tuner having an in-line gear configuration which provides for dual input to output shaft rotation ratios, thus enabling both coarse adjustment and fine tuning of the string tension on a stringed instrument.

SUMMARY OF THE INVENTION

The present invention is directed to a tuner device for stringed instruments which is specifically structured to provide for both coarse adjustment and fine tuning of the string tension. The device includes an in-line drive gear assembly including a first reduction gear assembly, operable by turning a first adjustment knob, to rotate a string output shaft and spindle at a reduced rotation of approximately a 4:1 ratio. The drive gear assembly further includes a second reduction gear assembly, in-line with the first reduction gear assembly, and operable in conjunction therewith by turning a second adjustment knob to effectively rotate the string spindle at a higher reduction ratio of approximately 16:1 (16 turns of the second adjustment knob for each rotation of the spindle).

With the foregoing in mind, it is a primary object of the present invention to provide a tuner device for stringed instruments and having a narrow housing and means for coarse adjustment and fine adjustment of string tension.

It is a further object of the present invention to provide a tuner device for stringed instruments comprising an in-line gear configuration structured to enable both coarse adjustment and fine adjustment of string tension.

It is still a further object of the present invention to provide a tuner device for stringed instruments comprising a stacked, multi-stage planetary gear drive configuration which can be housed in a narrow, streamlined housing and which is further structured to enable both coarse adjustment and fine adjustment of string tension.

It is still a further object of the present invention to provide a tuner device as described above for use to adjust the fifth string on a banjo.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
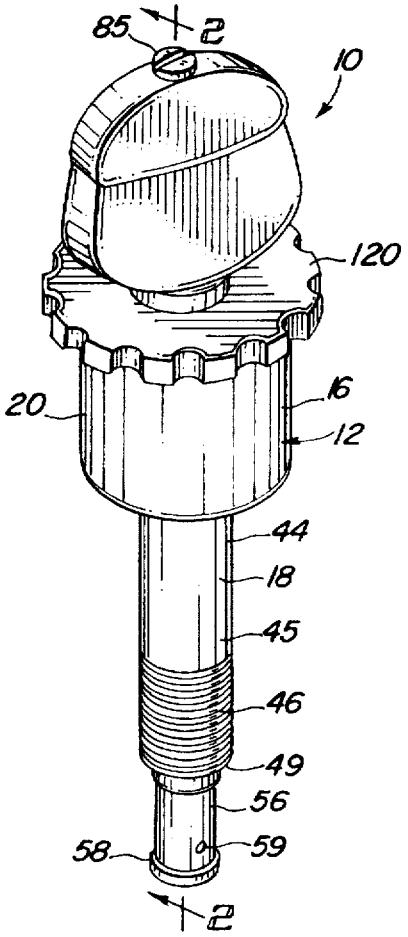
FIG. 1 is a perspective view of a first embodiment of the tuning device of the present invention.
Figure 2:
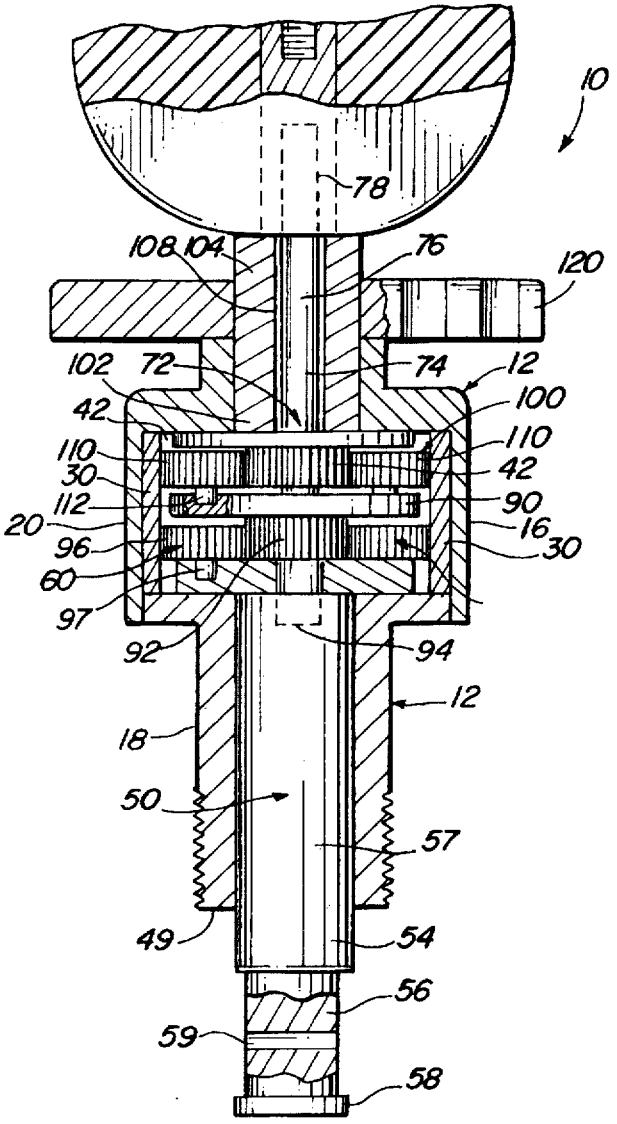
FIG. 2 is a partial sectional view, in cutaway, taken along the plane indicated by the line 2—2 in FIG. 1.
Figure 5:
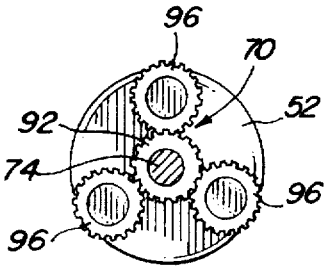
FIG. 5 is a top plan view of a primary reduction gear assembly of the device taken along the plane indicated by the line 5—5 of FIG. 3.
Figure 3:
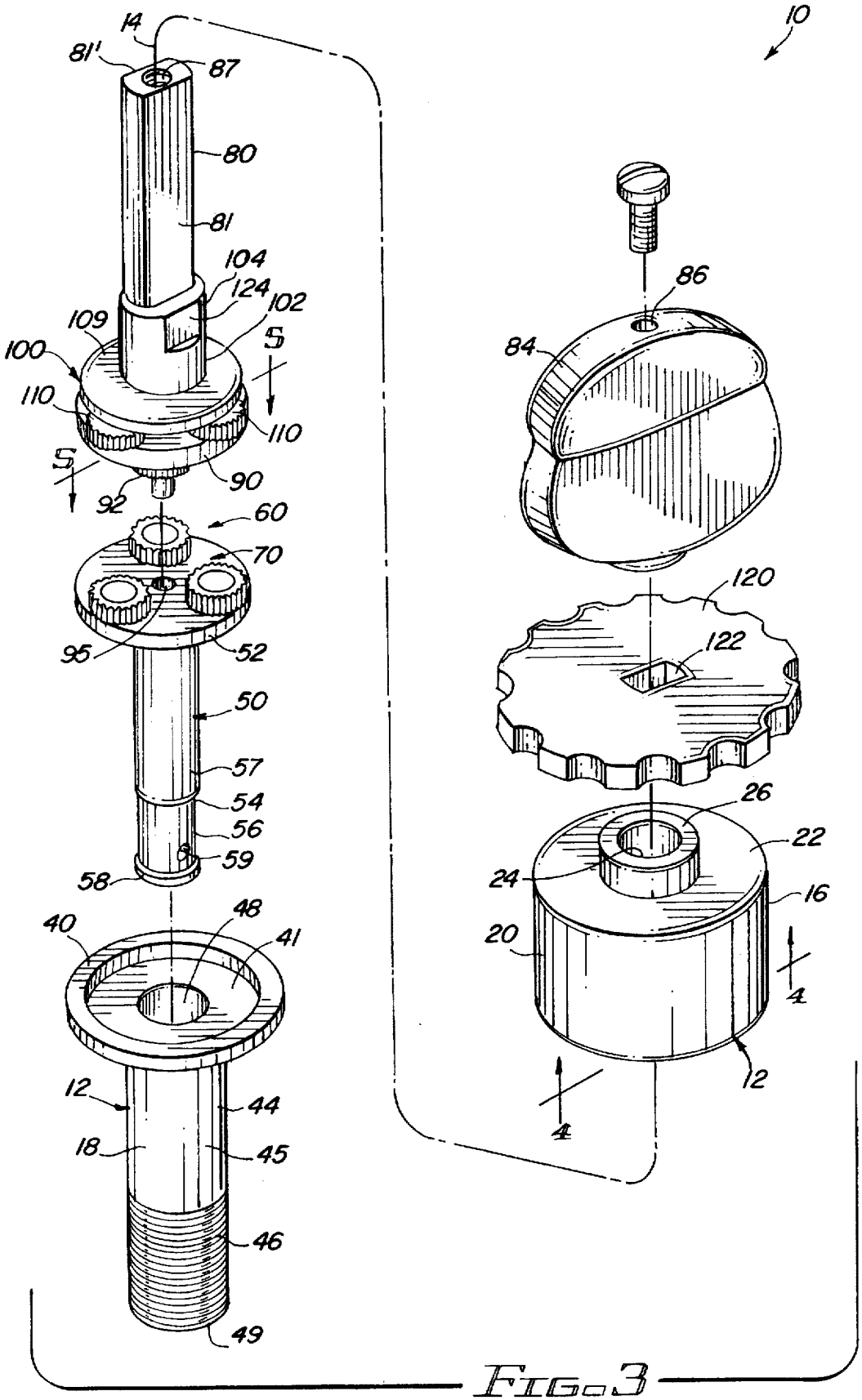
FIG. 3 is an exploded perspective view illustrating the component parts of the device.

Referring to the several views of the drawings, and initially FIGS. 1–3, the first embodiment of the tuning device of the present invention is illustrated and is generally indicated as 10. The tuning device 10 includes a housing 12 having a central longitudinal axis indicated by the line 14, in FIG. 3, and upper portion 16 and a lower, generally elongate portion 18.

Figure 4:
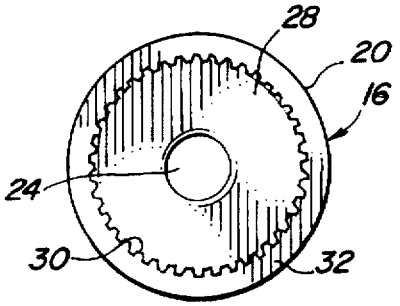
FIG. 4 is a plan view taken along the plane indicated by the line 4—4 of FIG. 3.

The upper portion 16 of the housing 12 includes a cylindrical side wall 20, a top end 22 with a centrally disposed aperture 24 surrounded by an annular raised rim 26 defining a seat. The upper portion 20 further includes an open bottom 28, as best seen in FIG. 4. An inner surface of the cylindrical wall 20 is provided with a toothed configuration defining an annular gear track 30 which extends about the circumference of the inner surface of cylindrical wall 20, terminating above a bottom edge 32 of the upper portion 16.

The lower elongate portion 18 of the housing 12 is provided with a flanged circular plate 40 on an upper end, defining a cover sized and configured for attachment in covering relation to the open bottom 28 of the upper portion 16 to partially enclose an interior gear chamber 42 within the upper portion 16 of the housing 12. The lower portion 18 is further provided with an elongate, generally tubular extension 44 including a central zone 45 and a lower end zone 46. The lower end zone 46 is provided with thread means thereon to facilitate threaded attachment of the device 10 to the tail piece of a stringed musical instrument such as a guitar or banjo. A hollow axial bore 48 extends through the length of the lower portion 18 from the top plate 40 to a bottom end 49. When the lower portion 18 is attached to the upper portion 16 of the housing 12, the bore 48 is disposed in co-axial alignment with the central longitudinal axis 14.

An output shaft 50 is fitted through the axial bore 48 and is permitted to rotate freely therein. A circular plate 52 integrally formed on a proximal end of the shaft 50 and is rotatable therewith. As seen in FIG. 2, the circular plate 52 is operatively positioned within a lower portion of the gear chamber 42 and seats against a top surface 41 of the flanged plate 40 on the lower housing portion 18. A distal end zone 54 includes a string spindle 56 defined by a reduced diameter portion between a central portion 57 and distal end 58 of the shaft 50. The distal end zone 54 of the output shaft 50 extends axially beyond the bottom end 49 of the lower housing portion 18 so that the spindle 56 is completely exposed. The string spindle 56 is specifically structured to receive and collect the instrument string thereabout as the shaft 50 is drivingly rotated in one direction, to thereby increase string tension. When the spindle 56 is rotated in the opposite direction, the string is unwound and progressively released from the spindle to reduce string tension. An aperture 59 extends through the spindle 56 so that the instrument string can be fed therethrough and fixed on the spindle 56 in order to initiate winding of the string on the spindle.

The output shaft 50 is drivingly rotated by a drive gear assembly 60 housed within the gear chamber 42. The drive gear assembly 60 is specifically structured to reduce rotation between a plurality of input rotational forces and the output shaft 50 by transmitting the input rotational forces and drivingly engaging the output shaft 50 using a dual reduction gear assembly. The dual reduction gear assembly includes a first reduction gear assembly 70 for drivingly rotating the output shaft 50 and, accordingly, the string spindle 56, at a first output rate of rotation. In the preferred embodiment, the ratio between an input rotational force and the resultant rate of rotation of the output shaft 50 produced by the first reduction gear assembly 70 is approximately 4:1. This ratio can be altered by changing the gear size in the first reduction gear assembly 70, but is generally intended to be a lower reduction ratio between an input rotational force and the output shaft 50 in order to provide for coarse adjustment of string tension and initial string winding when replacing a string on the instrument.

The first reduction gear assembly 70 includes an integral primary drive element 72 having an elongate axial shaft 74 disposed in co-axial alignment along the central longitudinal axis 14. The axial shaft 74 includes an upper extension 76 which passes through the aperture 24 in the top end 22 of the upper housing portion 16 and defining a first input shaft for imputing a first rotational force to engage the first reduction gear assembly and drive the output shaft 50 in accordance with the first rate of rotation. The upper extension 76 of the axial shaft 74 terminates at a top end zone 78 substantially beyond the top 22 of the housing 12 and is adapted for attached receipt within a bore formed through the bottom of a key element 80 having opposite flat sides 81, 81'. The key element 80 is sized and configured for fitted receipt within a congruently configured channel within a knob 84. The knob 84 is fixed to the key element 80 by a screw 85 which fits through a top hole 86 in the knob 84 for threaded engagement within a threaded bore 87 in the top of the key element 80. The flat sides 81, 81' on the key element 80 prevent rotation of the key element 80 within the channel of the knob 84 so that when the knob 84 is turned, an input rotational force is transmitted through the upper extension 76 of the shaft 74 to effectively rotate the entire primary drive element 72 at the first input rate of rotation.

The primary drive element 72 is further provided with an integral circular follower plate 90 and a primary drive gear 92 adjacent to and below the follower plate 90. The follower plate 90 is concentrically positioned within the gear chamber 42 and rotates about the central longitudinal axis 14 upon driven rotation of the shaft 72. A lower shaft extension 94 extends axially below the primary drive gear 92 opposite the upper shaft extension 76 in co-axial alignment along the central longitudinal axis 14. The lower shaft extension 94 is received within an aperture 95 formed in the plate 52.

A plurality of primary planetary gears 96 are rotatably fitted to the circular plate 52 on stub shafts 97 which extend from the bottom of the planetary gears 96 and within a corresponding hole formed in the top of the plate 52. Each of the planetary gears 96 are fitted within the gear chamber 42 so as to be in intermeshing, driven engagement with the primary drive gear 92 and the annular gear track 30 formed about the inner surface of the wall 20 of the upper housing 16. The stub shafts 97 on which the planetary gears 96 rotate are positioned equidistant from and radially outward of the central longitudinal axis 14.

In operation, the primary drive gear 92, driven by rotation of the shaft 72, engages the primary planetary gears 96 which are thereby caused to rotate and travel about the annular gear track 30 due to their intermeshing engagement therewith. The forced travel of the planetary gears 96 about the annular gear track 30 results in the short stub shafts 97 traveling about a circumferential path which imparts a tangential force on the plate 52, radially outward of the central longitudinal axis 14, thus pulling the plate 52 so that the plate 52 rotates about the central longitudinal axis 14. The resultant rotation of the plate 52 in turn rotates the output shaft 50 and, accordingly, the string spindle 56, in accordance with the first output rate of rotation which is reduced approximately four times relative to the input rate of rotation of the shaft 72.

The dual reduction gear assembly of the drive gear assembly 60 further includes a second reduction gear assembly 100 for drivingly rotating the string spindle 56 at a second output rate of rotation. In the preferred embodiment, the ratio between a second input rotational force and the resultant second output rate of rotation of the output shaft 50 produced by the second reduction gear assembly 100 is approximately 16:1. This higher reduction ratio between the input rotational force and the output shaft 50 provides for a fine adjustment of string tension, particularly suited to fine tune the stringed musical instruments without overshooting proper string tension.

The second reduction gear assembly 100 includes a secondary drive element 102 rotatably disposed in co-axial alignment along the central longitudinal axis 14. The secondary drive element 102 has a tubular extension 104 and an integral secondary drive gear 106 on a lower end, just below the tubular extension 104. An axial, concentric bore 108 extends longitudinally through the secondary drive element along the central longitudinal axis 14. The secondary drive gear 106 is positioned within the gear chamber 42 and a plate 109 integrally formed on the secondary drive element 102 abuts against the upper inner surface of the upper housing portion 16. The tubular extension 104 extends upwardly through the aperture 24 in the upper housing 16 beyond the annular rim 26 so that a portion of the tubular extension 104 is exposed externally of the housing 12. The plate 109 is larger in diameter than the aperture 24, thus preventing the lower portion of the secondary drive element 102, having the secondary drive gear 106, from being pulled through the aperture 24, thus maintaining the secondary drive 106 in proper orientation within the gear chamber 42. The concentric bore 108 is sized for receipt of the upper extension 76 of the axial shaft 74 therethrough, permitting free and uninterrupted rotation of the axial shaft 74 therein.

The second reduction gear assembly 100 further includes a plurality of secondary planetary gears 110 which are each rotatably fitted to a top side of the follower plate 90 of the primary drive element 72 on stub shafts 112 which extend from the bottom of each of the secondary planetary gears 110 and within a corresponding hole formed in the top of the follower plate 90. The stub shafts 112 of each of the secondary planetary gears 110 are positioned within the holes on the follower plate 90 at points equidistant from and radially outward of the central longitudinal axis 14. Each of the secondary planetary gears 110 are fitted in intermeshing, driven engagement with the secondary drive gear 106 and the annular gear track 30.

In operation, the secondary drive gear 106, driven by rotation of the tubular extension 104, engages the secondary planetary gears 110 which are thereby caused to rotate and travel about the annular gear track 30 due to their intermeshing engagement therewith. The forced travel of the secondary planetary gears 110 about the annular track 30 results in the short stub shafts 112 travelling about a circumferential path which imparts a tangential force on the follower plate 90, radially outward of the central longitudinal axis 14, thus causing the follower plate 90 to rotate about the central longitudinal axis 14. Driven rotation of the follower plate 90, by the second reduction gear assembly 100, results in driven rotational engagement of the first reduction gear assembly 70 and, thereby, driving the string spindle 56 at the second output rate of rotation due to the dual stepped reduction of an input rotational force imparted on the tubular extension 104.

To facilitate rotation of the tubular extension 104, thus engaging the dual stepped reduction gear assembly, a knob in the form of a wheel 120 is attached to the upper portion of the tubular extension 104 between the annular rim 26 and the knob 84. The wheel knob 120 includes a slot 122 formed through its center for locking engagement with flat surfaces 124 formed on opposite sides of the tubular extension 104. Engagement of the flat surfaces 124 within the slot 122 prevents relative rotation of the wheel knob 120 about the tubular extension 104 so that when the wheel knob 120 is rotated, the tubular extension 104 is caused to rotate therewith at the same input rate of rotation.

Figure 6:
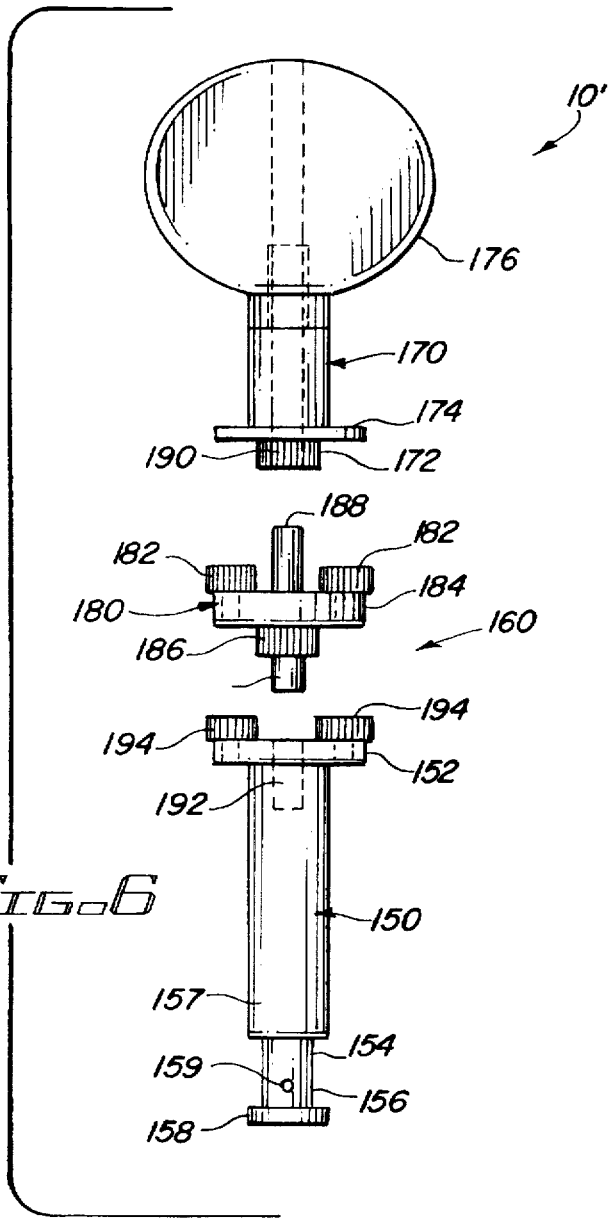
FIG. 6 is an exploded elevational view illustrating a second embodiment of the tuning device.
Figure 7:
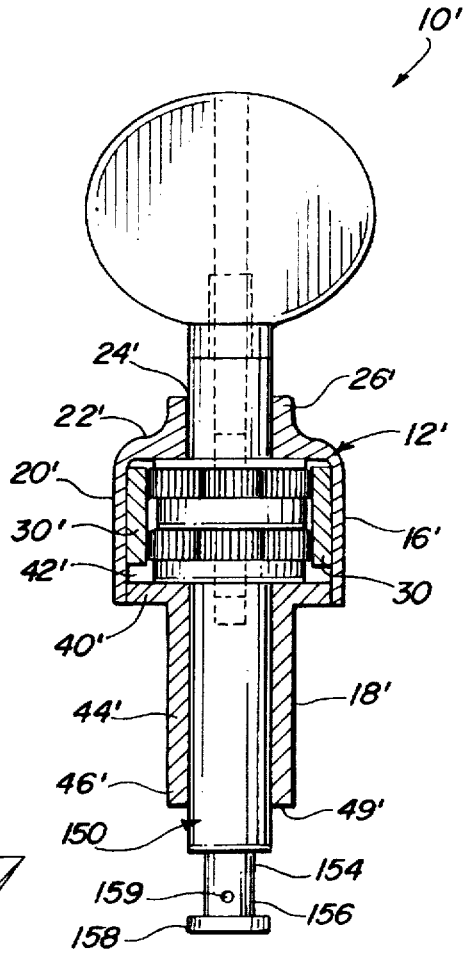
FIG. 7 is a front elevational view, in partial section, illustrating the embodiment of FIG. 6 in complete assembly.

Referring now to FIG. 6 and 7, a second embodiment of the tuning device is illustrated and generally indicated as 10'. Much like the first embodiment, the tuning device 10' includes a housing 12' having a central longitudinal axis, an upper portion 16' and a lower, generally elongate portion 18'.

The upper portion 16' of the housing 12' includes a cylindrical side wall 20', a top end 22' with a centrally disposed aperture 24' surrounded by an annular raised rim 26'. An inner surface of the cylindrical side wall 20' if provided with a toothed configuration defining an annular gear track 30' which extends about the circumference of the inner surface of the cylindrical wall 20, as seen in FIG. 7.

The lower elongate portion 18' of the housing 12' is provided with a flanged circular plate 40' on an upper end, defining a cover sized and configured for attachment in covering relation to an open bottom of the upper portion 16 to partially enclose an interior gear chamber 42' within the upper portion 16' of the housing 12'. The lower portion 18' is provided with an elongate, generally tubular extension 44'. The lower end zone 46' of the tubular extension 44'0 is provided with thread means or other attachment means, much like that of the first embodiment (not shown in FIG. 7 for purposes of clarity), to facilitate attachment of the device 10' to the tail piece of a stringed musical instrument such as a guitar or banjo.

An output shaft 150 is fitted through a hollow axial bore of the lower portion 18' of the housing and is permitted to rotate freely therein. A circular plate 152, integrally formed on a proximal end of the shaft 150, is rotatable with the output shaft 150. The circular plate 152 is operatively positioned within a lower portion of a gear chamber 42' and seats against a top surface of the flanged plate 40' on the lower housing portion 18'. A distal end zone 154 of the output shaft 150 includes a string spindle 156 defined by a reduced diameter portion between a central portion 157 and a distal end 158. The distal end zone 154 of the output shaft 150 extends axially beyond the bottom end 49' of the lower housing portion 18' so that the spindle 156 is completely exposed. The string spindle 156 is specifically structured to receive and collect the instrument sting thereabout as the output shaft is driving rotated in particular direction, to thereby increase string tension. When the string spindle 156 is rotated in the opposite direction, the string is released from the spindle and thus string tension is reduced. An aperture 159 extends through the spindle 156 so that the instrument string can be fed therethrough and fixed on the spindle 156 in order to initiate winding thereabout.

The output shaft 150 is drivingly rotated by a drive gear assembly 160 housed within the gear chamber 42'. The drive gear assembly 160 is specifically structured to reduce rotation from an input rotational force to a resultant output rotation of the output shaft 150 by means of a stacked dual reduction gear assembly which is part of the overall drive gear assembly 160. This unique stacked reduction gear assembly provides for a reduction in ratio from an input rotational force to the output shaft 150 at a reduction ration of 9:1 or higher. In a preferred embodiment, the reduction ration between and input rotational force and the resultant output rotation of the output shaft 150 is at a ration of 16:1, thus providing for accurate fine tuning of a musical instrument. The configuration of the gear assembly enables a high reduction ratio without affecting the size of the footprint on the instrument or the traditional in-line system which is preferred for use on banjos.

Referring now to FIG. 6, the component elements of the drive gear assembly 160 are illustrated. A primary drive element 170 interconnects in fixed attachment to a tuning knob 176 at one end and includes a primary drive gear 172 integrally formed thereon at an opposite end. An annular plate 174 is integrally formed on the primary drive element 170 just above the primary drive gear 172.

A primary follower element 180 includes a circular base 184. Primary planetary gears 182 are rotatably fitted to a top of the circular base 184 and are adapted to drivingly engage the annular gear track 30' upon driven rotation by the primary drive gear 172. The primary follower element 180 further includes a secondary drive gear 186 integrally formed thereon below the circular base 184.

An upper axle 188 extends from the circular base and is rotatably received within an axial socket 190 formed through a bottom of the primary drive element 170 along the central longitudinal axis of the device 10'. A lower axle 189 extends from the bottom of the primary follower element 180 and is rotatably received within an axial socket 192 formed through the top plate 152 and into an upper portion of the output shaft 150.

The secondary drive gear 186 drivingly engages secondary planetary gears 194 rotatably fitted to a top of the plate 152. The secondary planetary gears 194 further drivingly engage the annular gear track 30' upon driven rotation to cause the plate 152 and integral output shaft 150 to rotate in accordance with the desired output rotation rate.

In use, the device is operated by first turning the tuning knob 176 which, being fixedly attached to the primary drive element 170 results in rotation of the primary drive gear 172 at the same rate. As the primary drive gear 172 rotates, the primary planetary gears 182 are caused to rotate and travel about the annular gear track 30' resulting in driven rotation of the primary follower element 180 at a reduced ratio relative to the rate of rotation of the tuning knob 176 and primary drive gear 172. Rotation of the primary follower element 180 and, accordingly, rotation of the secondary drive gear 186 further engages the secondary planetary gears 194 which are caused to travel about the annular gear track 30', thus rotating the plate 152 and output shaft 154 in accordance with a second reduced ratio. By multiplying the first reduction ratio by the second reduction ratio, the overall reduction ratio between the input rotation at the tuning knob 176 and the output rotation of the string spindle 156 is determined.

While the invention has been shown and described in what is considered to be practical and preferred embodiments thereof, it is recognized that departures may be made within the spirit and scope of the following claims which, therefore, should not be limited except within the doctrine of equivalents.

Now that the invention has been described,

What is claimed is:

1. A tuning device for controlling tension of a string on stringed instruments comprising:

a housing having a central longitudinal axis and including an upper portion having a top end with a centrally disposed aperture formed therethrough, and an annular wall surrounding an interior gear chamber having an inner toothed surface within said gear chamber defining an annular gear track, said housing further including a lower elongate portion having an axial bore extending therethrough in co-axial alignment with said aperture on said top end and said longitudinal axis, said axial bore extending from said interior gear chamber to an open bottom end, an output shaft received through said axial bore of said lower elongate portion of said housing and including a distal end zone with a string spindle thereon for winding the string thereabout, said distal end zone extending axially from said open bottom end, said output shaft further including an opposite proximal end including an integral circular plate rotatably disposed within said gear chamber in concentric alignment with said central longitudinal axis, a drive gear assembly for drivingly rotating said output shaft and string spindle and including:

a first reduction gear assembly for drivingly rotating said string spindle at a first output rate of rotation and including an integral primary drive element having an elongate axial shaft disposed in co-axial alignment along said central longitudinal axis and including an upper extension received through said aperture in said top end of said housing and a lower extension within said gear chamber, said primary drive element further including a primary drive gear and a circular follower plate concentrically formed on said axial shaft between said upper and lower extensions and rotatable therewith within said gear chamber, said first reduction gear assembly further including a plurality of primary planetary gears rotatably fitted to said circular plate of said output shaft on axes equidistant from and radially outward of said central longitudinal axis and engaging said primary drive gear and said annular gear track, said primary planetary gears being driven by said primary drive gear to cause said primary planetary gears to travel about said annular gear track and to exert a rotational force on said circular plate through said axes, resulting in driven rotation of said output shaft and said string spindle at said first output rate of rotation, a second reduction gear assembly for drivingly rotating said string spindle at a second output rate of rotation and including a secondary drive element rotatably disposed in co-axial alignment along said central longitudinal axis and having a tubular extension, an integral secondary drive gear on a lower end of said tubular extension, and an axial concentric bore for receipt of said upper extension of said axial shaft of said primary drive element therethrough, and said second reduction gear assembly further including a plurality of secondary planetary gears rotatably fitted to said follower plate of said primary drive element on axes equidistant from and radially outward of said central longitudinal axis and engaging said secondary drive gear and said annular gear track, said secondary planetary gears being driven by said secondary drive gear to cause said secondary planetary gears to travel about said annular gear track and to exert a rotational force on said follower plate through said respective axes thereof, resulting in driven rotational engagement of said first reduction gear assembly and, thereby, driving said string spindle in accordance with said second output rate of rotation, and knob means for applying an external rotational force to said first reduction gear assembly and said second reduction gear assembly for driven engagement thereof.

2. A tuning device as recited in claim 1 wherein said knob means includes a first knob fixedly attached to said upper extension of said primary drive element to facilitate manual turning thereof for applying a first input rotational force to said primary drive element.

3. A tuning device as recited in claim 2 wherein said knob means further includes a second knob fixedly attached to an upper portion of said tubular extension of said secondary drive element to facilitate manual turning thereof for applying a second input rotational force to said secondary drive element.

4. A tuning device as recited in claim 3 wherein the ratio of the first input rotational force to the first output rate of rotation of said string spindle is 8:1 or less.

5. A tuning device as recited in claim 4 wherein the ratio of the second input rotational force to the second output rate of rotation of said string spindle is 10:1 or greater.

6. A tuning device for controlling tension of a string on stringed instruments comprising:

a housing having an inner gear chamber and a central longitudinal axis extending between a top end and a bottom end, an output shaft axially aligned along said central longitudinal axis and including a proximal end operatively fitted within said gear chamber, and a distal end zone extending axially from said bottom end of said housing and including a string spindle thereon for winding the string thereabout, a drive gear assembly in driving engagement with said output shaft for rotating said output shaft and string spindle and including:

a first reduction gear assembly for drivingly rotating said output shaft and string spindle at a first output rate of rotation and including an integral primary drive element having an elongate axial shaft disposed in coaxial alignment along said central longitudinal axis, and a second reduction gear assembly for drivingly rotating said output shaft and said string spindle at a second output rate of rotation and including a secondary drive element rotatable disposed in coaxial alignment along said central longitudinal axis and having a tubular extension, and knob means for applying an external rotation force to said first reduction gear assembly and said second reduction gear assembly for driven engagement thereof.

7. A tuning device as recited in claim 6 wherein said knob means includes a first knob fixedly attached to an upper extension of said primary drive element to facilitate manual turning thereof for applying a first input rotational force to said primary drive element.

8. A tuning device as recited in claim 7 wherein said knob means further includes a second knob fixedly attached to an upper portion of said tubular extension of said secondary drive element to facilitate manual turning thereof for applying a second input rotational force to said secondary drive element.

9. A tuning device as recited in claim 8 wherein the ratio of the first input rotational force to the first output rate of rotation of said string spindle is 8:1 or less.

10. A tuning device as recited in claim 9 wherein the ratio of the second input rotational force to the second output rate of rotation of said string spindle is 10:1 or greater.

11. A tuning device for controlling tension of a string on stringed instruments comprising:

a housing having an inner gear chamber and a central longitudinal axis extending between a top end and a bottom end, an output shaft axially aligned along said central longitudinal axis and including a proximal end operatively fitted within said gear chamber, and a distal end zone extending axially from said bottom end of said housing and including a string spindle thereon for winding the string thereabout, a drive gear assembly in driving engagement with said output shaft for rotating said output shaft and string spindle and including:

a first reduction gear assembly positioned and disposed in axial alignment along said central longitudinal axis, and a second reduction gear assembly positioned and disposed in axial alignment along said central longitudinal axis and in driven engagement with said first reduction gear assembly, and knob means for applying an external rotational force to said drive gear assembly for driven engagement of said output shaft in accordance with a predetermined reduction ratio between rate of rotation of said external rotational force and a rate of rotation of said output shaft.

* * * * *